US005206450A

United States Patent [19]

Piesik

[11] Patent Number: 5,206,450

[45] Date of Patent: Apr. 27, 1993

[54] MULTI-MISSILE CANISTER GAS MANAGEMENT SYSTEM

[75] Inventor: Edward T. Piesik, Pomona, Calif.

[73] Assignee: General Dynamics Corporation Air Defense Systems Division, Pomona, Calif.

[21] Appl. No.: 698,769

[22] Filed: May 13, 1991

[51] Int. Cl.[5] ..... F41F 3/077

[52] U.S. Cl. ..... 89/1.8; 89/1.812

[58] Field of Search ..... 89/1.816, 1.812, 1.8

[56] References Cited

U.S. PATENT DOCUMENTS

| | | | |
|---|---|---|---|
| 2,105,735 | 1/1938 | Hodge | 49/193 |
| 2,350,981 | 6/1944 | Bescherer | 49/21 |
| 2,445,423 | 7/1948 | Eastman | 89/1.816 |
| 3,011,406 | 12/1961 | Werle et al. | 89/1.818 |
| 3,052,303 | 9/1962 | Lapp | 89/1.812 |
| 3,076,385 | 2/1963 | Bornhoft | 89/1.806 |
| 3,081,970 | 3/1963 | Einarsson | 244/114 B |
| 3,226,063 | 12/1965 | Wagner | 244/114 B |
| 3,228,294 | 1/1966 | Hickman | 89/1.8 |
| 3,363,508 | 1/1968 | Stahmer | 244/63 |
| 3,436,036 | 4/1969 | Madelung | 244/114 R |
| 3,645,478 | 2/1972 | Madelung | 244/114 B |
| 4,044,648 | 8/1977 | Piesik | 89/1.812 |
| 4,134,327 | 1/1979 | Piesik | 89/1.812 |
| 4,173,919 | 11/1979 | Piesik | 89/1.816 |
| 4,433,606 | 2/1984 | Hagelberg et al. | 89/1.812 |
| 4,683,798 | 8/1987 | Piesik | 89/1.816 |
| 4,686,884 | 8/1987 | Piesik | 89/1.816 |
| 4,934,241 | 6/1990 | Piesik | 89/1.816 |

*Primary Examiner*—David H. Brown

*Attorney, Agent, or Firm*—Henry Bissell; Leo R. Carroll

[57] ABSTRACT

An exhaust gas management system for missile launch arrangements which incorporates multiple launch cells exhausting into a common plenum. The system provides a flow passage configuration with a transition section that permits rocket exhaust flow gas to expand to fill the channel area downstream of the nozzle exit. Automatic aft closure members are included which serve to close off the flow passages to inactive cells while providing an open passage for exhaust gases from an active cell undergoing a missile firing. This arrangement prevents back flow or recirculation of exhaust gases into the volume in the cell which is upstream of the rocket nozzle exit.

12 Claims, 2 Drawing Sheets

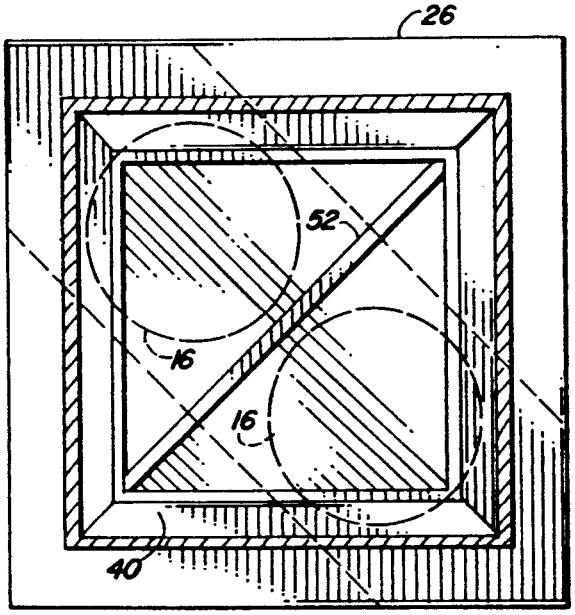
FIG. 5
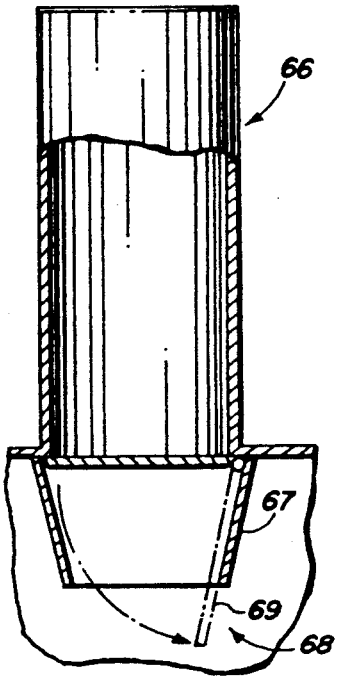
FIG. 6
(PRIOR ART)
FIG. 7
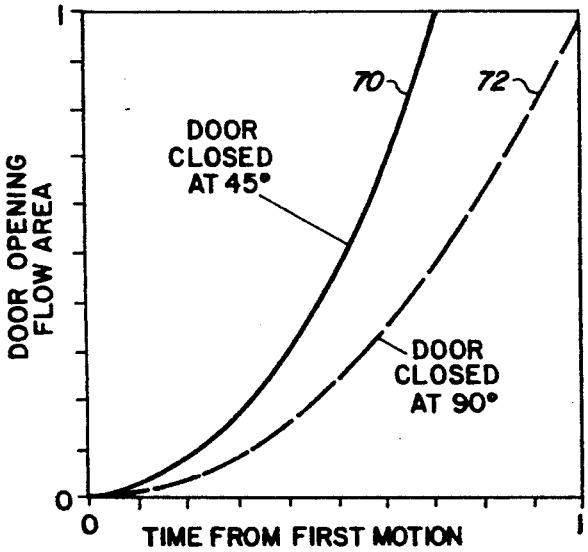
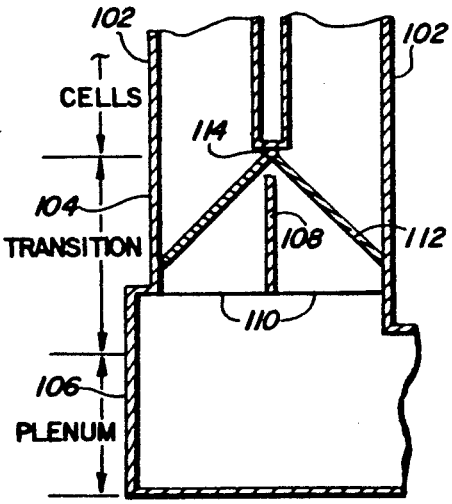
FIG. 11
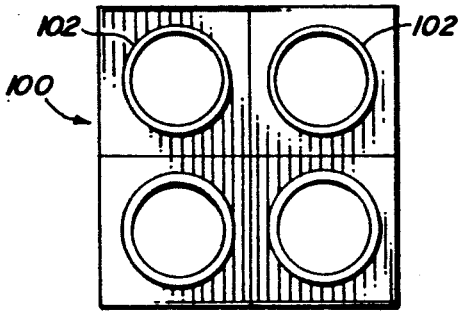
FIG. 10
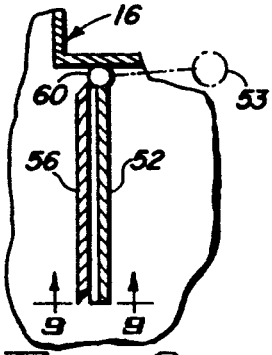
FIG. 8
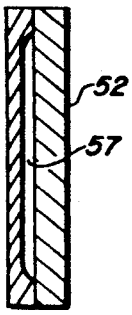
FIG. 9

MULTI-MISSILE CANISTER GAS MANAGEMENT SYSTEM

BACKGROUND OF THE INVENTION

1. Field of the Invention

The present invention relates to the field of controlled flow, exhaust manifold systems and, more particularly, to apparatus for controlling the flow of exhaust gases from a single missile being fired in a multi-missile canister and directed into a common exhaust gas manifold or plenum tube connected thereto.

2. Description of the Related Art

In certain military applications, particularly on warships having missile firing capability, the missiles are stored in a series of vertically oriented chambers closely adjacent one another. Exhaust gas outlets are normally provided to duct rocket exhaust gases generated during intended or accidental rocket ignitions to a safe location. In such installations, manifolding of a number of chambers into a common exhaust duct or plenum tube has become conventional.

There have been a number of approaches to the problems attendant upon the use of a common exhaust duct with a plurality of missile storage chambers. It is important to be able to block the exhaust gases from a missile which is being fired from blowing out through the individual chambers of other missiles. This is commonly accomplished by the use of doors or hinged panels which can open into the plenum chamber from the force of an impinging missile exhaust for the chamber containing the missile being fired and which can close off the passage at the base of a missile chamber opening into the exhaust plenum for other missiles.

Eastman U.S. Pat. No. 2,445,423 discloses apparatus having a plurality of individual missile chambers coupled to a common plenum chamber with a plurality of hinged, spring-loaded doors at the juncture of each individual missile chamber with the plenum tube. These doors open for a rocket that is being fired and serve to confine the exhaust gases within the plenum chamber and away from other missile-storage chambers.

There is also the problem of a portion of the rocket exhaust backing up into the chamber of the missile being fired and possibly over-pressurizing that missile chamber.

My own prior U.S. Pat. No. 4,044,648, the entire disclosure of which is incorporated by reference as though fully set forth herein, discloses a pair of hinged doors at the base of each missile storage chamber in the passage connecting the chamber to an associated exhaust plenum duct. The pressure forces on opposite sides of the doors during the firing of a missile are balanced to control the degree to which the doors are opened in order to adjust the opening to the varying dimension of the rocket exhaust stream as the missile rises and leaves the chamber upon firing. As a consequence, the rocket exhaust stream functions as a suitable "gas plug" in the opening in order to prevent recirculation of the exhaust gases back into the chamber undergoing firing.

It is important to control the rocket exhaust gas stream so that the gas plug is effective to prevent recirculation of exhaust gases back into the chamber. Control of the rocket exhaust stream on a dynamic basis to develop the gas plug effect appears to be more effective for the intended purpose than the use of fixed structure such as baffles, valves, diverters or the like which oftentimes have the undesirable result of interfering with the direct exhaust gas stream in their attempt to control flow, limit reverse circulation, etc. My prior U.S. Pat. No. 4,683,798, the entire disclosure of which is incorporated by reference as though fully set forth herein, discloses hinged doors near the lower end of each missile storage chamber but spaced from the juncture with the common plenum chamber by a transition region which provides a smooth transition from a generally square cross-section chamber in which a missile is stored and launched to a round exit opening in the chamber which connects with the exhaust plenum. This enhances the gas plug effect and uses it to prevent recirculation of exhaust gases back into the chamber of the missile being fired.

My prior U.S. Pat. No. 4,686,884, the entire disclosure of which is incorporated by reference as though fully set forth herein, discloses an arrangement including sets of doors to close off missile storage chambers coupled to a common plenum chamber upon the firing of a missile in another chamber with the addition of pivotable deflector panels which are installed in transition sections between the missile storage and launch chambers proper and the common plenum chamber.

The gas management system of the present invention incorporates some of the principles which are applicable to the systems of my prior patents cited hereinabove. However, the present system is intended for missile launch systems with multiple launch cells exhausting into a common plenum but with the cells arranged in clusters—e.g., by pairs—sharing common exhaust transition regions before reaching the juncture with the common plenum.

SUMMARY OF THE INVENTION

In brief, arrangements in accordance with the present invention comprise missile launch systems incorporating a plurality of launch cells exhausting into a common plenum. The construction of the system is such that the minimum flow area for exhaust gases resides in the canister or cell from which the fired missile is being launched. This flow area is such that, during the missile traversal of the launch canister, the supersonic rocket exhaust flow cannot negotiate the minimum flow area without "choking". "Choking" occurs when the product of the flow density and velocity is less than the mass flow rate per unit flow area, as described by the Continuity Equation. At the onset of "choke" conditions, the velocity at the minimum flow area has a Mach number which is just equal to 1.0. For some distance upstream, the flow is subsonic with the recovery pressure more than twice the pressure downstream of the minimum flow area.

Arrangements in accordance with the present invention involve rocket exhaust flow that expands to fill the designed channel area downstream of the rocket nozzle exit, even when opposed by the pressure which exists at or beyond the channel exit. Such systems thus prevent any back flow or recirculation of exhaust flow into the volume which is upstream of the rocket nozzle exit. The area downstream of the rocket nozzle is equal to or greater than the nozzle exit and is constant or increasing in size as a function of distance downstream from the nozzle. The disclosed embodiments are specifically designed to protect multi-missile canisters and the missiles therein during any normal or restrained missile firing in a Vertical Launcher System (VLS).

In accordance with an aspect of the invention, embodiments thereof utilize a single closure door near the aft end of each cylindrical launch cell in the multi-missile canister and further includes a transition section mating with the VLS plenum. This door opens under the influence of gas flow exhausting from an active rocket nozzle. The flow area through the door is not the restricting area in the system, but rather this is the minimum flow area as described hereinabove. The door is arranged to close under pressure from any opposing gas flow which is directed toward the rocket nozzle when the rocket is inactive. Upon reclosure, the door may latch and lock in place to isolate that cell from the remaining launch environment.

BRIEF DESCRIPTION OF THE DRAWINGS

A better understanding of the present invention may be realized from a consideration of the following detailed description, taken in conjunction with the accompanying drawing in which:

FIG. 5 is a sectional view taken along the line 5—5 near the bottom of FIG. 3 and looking upward in the direction of the arrows;

FIG. 6 is a cutaway elevation showing the construction of a prior art apparatus;

FIG. 7 is a graph depicting a plot of door opening time for different degrees of initial door closure;

FIG. 8 is a sectional elevation view of a particular door suspension arrangement for use in the embodiments of my invention;

FIG. 9 is a view showing details of the door suspension of FIG. 8 as viewed from the underside along the line 9—9 looking upward in the direction of the arrows;

FIG. 10 is a schematic plan view of a four-missile canister system in accordance with the present invention; and FIG. 11 is a side sectional view of the arrangement of FIG. 10.

DETAILED DESCRIPTION OF THE PREFERRED EMBODIMENTS

Figure 1:
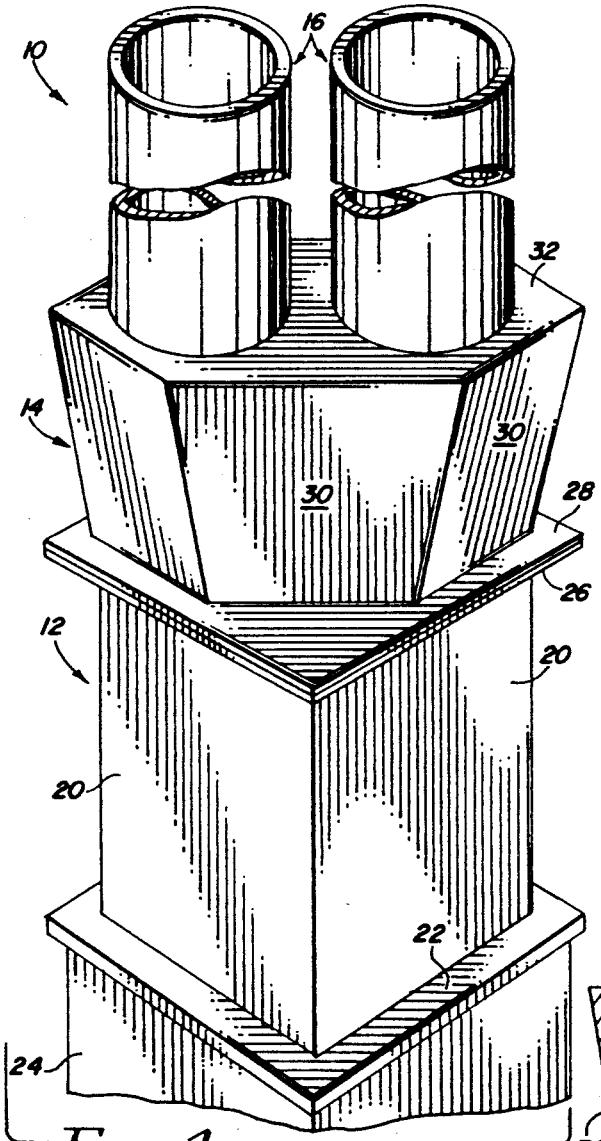
FIG. 1 is a perspective view of a multi-missile canister system incorporating my invention.
Figure 2:
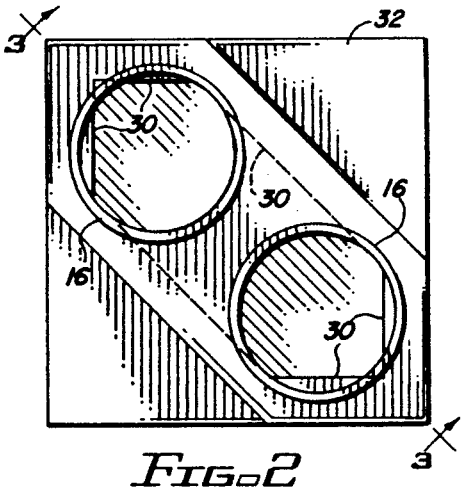
FIG. 2 is a plan view of the arrangement of FIG. 1.

First Embodiment - Dual Missile Canister System

One embodiment of my invention comprising a dual missile canister gas management system is depicted in FIGS. 1-5. This embodiment 10 principally comprises a lower transition section 12, an upper transition section 14 and a pair of missile canisters or cells 16 which sit atop the section 14. The section 12 is generally square (or rectangular) in cross section with adjacent sidewalls 20 joined at right angles and provided with a bottom flange 22 which serves to couple the system to an associated plenum chamber 24. This section 12 is not an essential part of my invention but is included where it is part of an existing installation to which arrangements in accordance with my invention are to be added.

The lower transition section 12 terminates in an upper flange 26 which is joined to a plate 28 to which the upper transition portion is attached. Vertically angled sidewalls 30 extend upwardly from the plate 28 to a second plate 32, to which the missile canisters 16 are attached. Adjacent sidewalls 30 are joined together, forming a six-sided configuration of the upper transition section 14. The upper plate 32 is provided with a pair of circular openings 34 to connect the interior volumes of the two missile canisters 16 with the upper transition portion 14. The plate 28 is provided with an opening 38 shaped to match the lower cross-sectional outline of the transition section 14 which serves to connect the interior spaces of the two transition portions 12 and 14. A tapered skirt 40 projects downwardly into the upper portion of the lower transition section 12, substantially continuing the angle with the vertical which is made by the walls 30 of the upper transition section 14.

Figure 3:
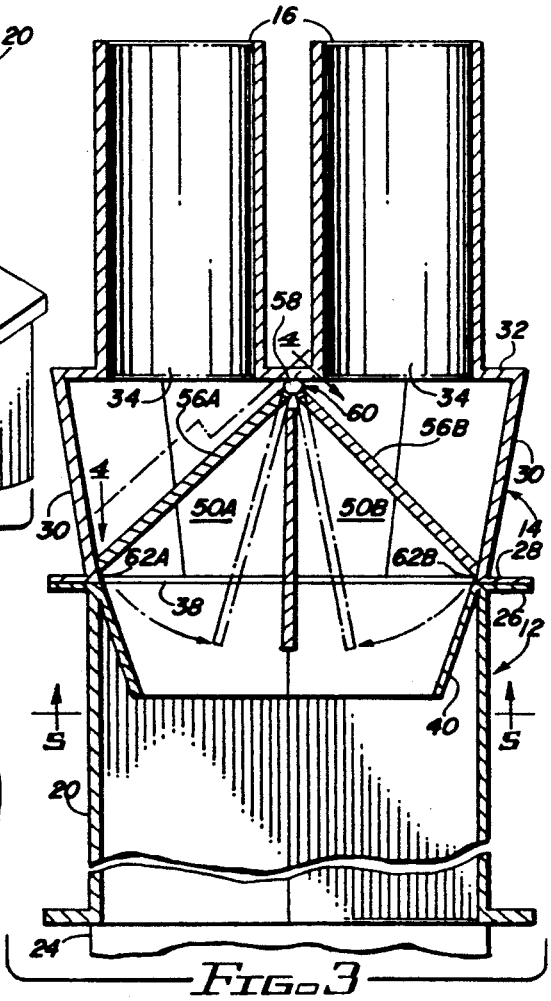
FIG. 3 is a sectional elevation of a multi-missile canister system in accordance with my invention, taken along the line 3—3 of FIG. 2 and looking in the direction of the arrows.

The upper transition portion 14 is divided into two compartments 50A and 50B by a transverse vertical plate 52 which extends across the interior of the transition section 14 between opposed sidewalls 30 in a plane which is orthogonal to a plane defined by the two longitudinal axes of the missile canister 16 (the plane of the paper in FIG. 3). This transverse vertical plate 52 extends from near the top of the upper transition section 14 into the space encompassed by the skirt 40.

Figure 4:
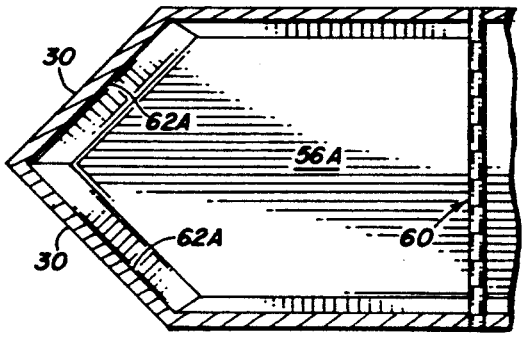
FIG. 4 is a view of a portion of FIG. 3 lying along the line 4—4 of FIG. 3 and looking in the direction of the arrows.

In each of the spaces 50A, 50B there is a hinged door, 56A or 56B. These two doors 56A, 56B are hinged to swing about a pivot point 58 by hinge mechanism 60. The doors 56A, 56B are shown in solid outline form in FIG. 3 in the closed position, wherein the terminal edge of a door, 62A or 62B, abuts against the lower edge of adjacent walls 30 of the upper transition section 14. This is best shown in FIG. 4, wherein the outline of the door 56A is depicted as shaped to match the hexagonal cross section of the upper transition section 14 at the angle of juncture. The doors 56A and 56B are shown in broken outline form in FIG. 3 as they transition from the fully closed position to the fully open position in which they rest flat against the vertical plate 52. It will be noted that the plate 52 extends to the lower edge of the doors 50A, 50B when the doors are in the fully open position. When in the closed position, the doors 50A, 50B completely block off the transfer of any exhaust gases upward into the missile cylinders 16 from the exhaust plenum. In the operation of the system 10, these doors open one at a time to permit exhaust gases from a missile being fired in one of the missile cylinders 16 to flow downwardly into the exhaust plenum 24 through the transition sections 12, 14 while limiting or preventing any reverse flow or recirculation back into the cell 16.

FIG. 6 shows one example of a prior art missile launcher system which includes a missile storage and launch canister 66, a transition section 67 and a plenum 68 with an exhaust duct (not shown). The canister 66 is sized to contain one missile with its attendant wings and fins. The rocket motor diameter and missile body are small, relative to the canister area. A hinged door 69 is provided to block reverse flow of gases from the plenum 68 into the canister 66. The arrangement in accordance with my invention depicted in FIGS. 1-5 makes it possible to double the number of missile canister which may be accommodated within the deck area formerly assigned to a single missile canister while achieving the desirable effects of the gas management system of the invention.

The preferred position for the closed doors of embodiments of my invention is at angle of about 45 degrees to the missile centerline, as is indicated in FIG. 3.

One advantage of this is the reduced response time following a rocket ignition and the reduction in kinetic energy of the opening door when it hits the back plate 52, compared with a door that closes at 90 degrees to the missile centerline. FIG. 7 is a graph of door opening time from full closure. The solid line 70 shows the time for opening a door which is closed at a 45 degree angle, whereas the broken line 72 is a plot of the opening time for a door which is closed at a 90 degree angle to the missile centerline (0 degrees reference angle) as in the prior art arrangement of FIG. 6. As is apparent from FIG. 7, the time to fully open the door is reduced by about 30% for a door which is closed at a 45 degree angle, compared with a door which is positioned perpendicular the missile centerline. The longer it takes the door to open, the greater the ignition pressure pulse in the active canister. Also, the impact velocity on the divider wall 52 (FIGS. 3 and 5) is reduced by approximately 30% for the 45 degree angled door configuration.

The operation of the rigid doors in a multi-missile canister is automatic and is powered by the rocket exhaust flows and related gas pressures in the vertical launch system. The active cell door is opened under the pressure of the active cell rocket exhaust and tends to close under the influence of any adjacent rocket exhaust flowing toward it. FIG. 8 shows such a configuration with a door which is counterbalanced by a counterbalancing weight, indicated in phantom by the reference numeral 53, so that it is biased toward closing from the fully opened position. A spring biasing arrangement in the hinge 60 could be provided as well. Alternatively, or in addition, the door may be configured to allow upward flowing gases to stagnate behind the fully opened door, as is indicated in the example of FIG. 9 which is a view from the underside of the door structure of FIG. 8. FIG. 9 shows a cavity 57 in the back side of the door 56 which provides a stagnation volume between the door 56 and the wall 52. As another option, the lip of the door 56 may be angled as shown at 59 in FIG. 8. With an angled lip 59, upwardly flowing gases will tend to force the door toward the closed position.

It will be understood that the rigid doors 56 are ablatively protected on both the top (missile side) and bottom (plenum side) surfaces with the top surface being provided with greater ablative protection in order to be able to withstand restrained firing exhaust impingement. The hinge mechanism 60 is shadowed from any direct exhaust impingement, but is ablatively coated as needed to provide protection from upwardly flowing exhaust gases from adjacent cell firings. Since certain ablative materials are non-charring, ablatively effective, flexible and reject aluminum oxide deposition under rocket exhaust impingement, an effective seal of the active cylinder aft end can be maintained prior to and after active cell rocket motor firing. A material bearing the designation REFSET L3203-6 is an example of a suitable ablative for this purpose.

A re-latch capability may be provided so that one of the doors in the multi-missile canister will re-latch upon firing in the next adjacent cell. Such re-latching is possible as a result of the pressure pulse which is imposed on a multi-missile vertical launch system at rocket motor ignition. This door re-latching capability is a one-time function. The re-latching mechanism would be activated as the doors opened by the active cell rocket exhaust and would latch and lock upon door closure which results from the firing pressure pulse in an adjacent cell. Once latched, the cell would be isolated from the vertical launch system environment for all additional firings.

Second Embodiment - 4-Pack Missile Canister System

A second embodiment 100 of my invention is represented schematically in FIGS. 10 and 11. This embodiment comprises a group of four missile canisters assembled and arranged for firing, one at a time, with the rocket motor exhaust being directed to the plenum through a common transition section. Thus, four missile cells or canisters 102 are shown in the plan view of FIG. 10. These cells 102 are coupled together via a transition section 104 to the common exhaust plenum 106 (FIG. 11). A transverse dividing wall 108 divides the transition section into two regions, and each of these is further bifurcated by a wall 110 extending orthogonally to the wall 108. In each of the regions formed by the dividing wall 108, there is a pair of doors, such as the door 112, which are pivotably supported by a central hinge mechanism 114. The action of the doors 112 is essentially the same as is described for the operation of the doors 56 in the embodiment of FIGS. 1-5. A single door 112 is opened during the firing of a rocket motor in the cell 102 with which the door 112 is associated. An open or partially opened door 112 is restored to the closed position upon the development of positive pressure in the plenum 106 for all missile canisters 102 which are not undergoing firing.

Thus, as shown and described hereinabove, particular arrangements in accordance with the present invention provide for an increase in the number of missile canisters in a vertical launch system which can be coupled to a single port of an exhaust gas plenum in a shipboard installation or the like. The disclosed embodiments include aft closures for the individual canisters of a multi-cell system which move to the open position under the influence of exhaust gases in the cell undergoing ignition while at the same time acting to close off other cells in the system and thereby prevent the upward flow of exhaust gases into those other cells. Operation of the end closures is automatic under the influence of the gas pressures on opposite sides of an individual door. Thus, improved control of exhaust gas flow and limitation of reverse circulation into a cell undergoing firing provide protection to the missiles and prevent the application of excessive gas pressures in the cells.

Although there have been described hereinabove various specific arrangements of a multi-missile canister gas management system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An exhaust gas management system for a multi-missile arrangement wherein at least two cells for containing missiles are arrayed side-by-side in a vertical launching orientation, said system comprising:

a first transition section which is variable in cross-sectional dimension and shape between an inlet and an outlet end, said inlet end having means defining an opening mating with the exhaust ends of said cells, said outlet end being generally rectangular in cross section for mating with an adjacent exhaust chamber;

at least two aft closures individually associated with said at least two cells, said closures being pivotably mounted at a common hinge mechanism situated between said cells and equidistant from the central axis thereof, said closures extending downwardly and outwardly from said common hinge mechanism to a region of contact with a wall of an associated cell at an acute angle with the axis of said cell;

at least one divider wall positioned downstream from said cells and in line with said hinge mechanism to divide said first transition section into equal volume spaces, each space providing room for movement of a corresponding aft closure therein between open and closed positions, said divider wall having means for arresting further movement of adjacent aft closures away from the closed position thereof; and means for controlling exhaust gas flow to automatically drive an open aft closure from an open position toward the closed position and to maintain a closed aft closure in the closed position in response to reverse exhaust gas glow toward said aft closure from an adjacent exhaust chamber.

2. The system of claim 1 wherein said adjacent exhaust chamber comprises a plenum chamber.

3. The system of claim 1 wherein said adjacent exhaust chamber comprises a second transition section connected between said first transition section and a plenum chamber.

4. The system of claim 1 wherein said at least two cells for containing missiles comprise four cells in a four-pack configuration, there being divider walls arranged orthogonally to each other to define four exhaust regions within said transition section, each region communicating with a corresponding one of said four cells and having a corresponding aft closure hingedly mounted therein.

5. The system of claim 1 wherein said first transition section is six-sided and wherein said inlet end comprises a first plate having a pair of circular openings therein for mating with said at least two cells in sealed relationship.

6. The system of claim 5 wherein said outlet end comprises a second plate defining a six-sided opening therein and having a peripheral flange for connecting to the flange of a generally rectangular cross-section in said adjacent exhaust chamber.

7. The system of claim 1 further including a skirt portion extending from said first transition section into said adjacent exhaust chamber, said skirt portion being shaped to accommodate movement of the periphery of said aft closures into said skirt portion from the closed position within said first transition section.

8. The system of claim 7 wherein said divider wall extends into said skirt portion by a predetermined amount and is coterminus with said aft closures in the open position.

9. The system of claim 1 wherein two adjacent sides of said first transition section are joined to form an acute angle remote from said hinge mechanism and wherein a corresponding aft closure is shaped having a pair of edges remote from said hinge mechanism which are joined at an acute angle which matches the acute angle of said two sidewalls in order to develop a seal between the aft closure and the sidewalls when the aft closure is in the closed position abutting against said sidewalls.

10. The system of claim 9 wherein said aft closures are mounted at said common hinge mechanism in a manner which permits them to extend along said divider wall on opposite sides thereof when said closures are in the open position.

11. The system of claim 10 wherein said means for controlling exhaust gas flow includes means for biasing an aft closure in a direction away from said divider wall and toward a closed position.

12. The system of claim 10 wherein said means for controlling exhaust gas flow comprises means defining a space between said divider wall and an adjacent aft closure to establish a gas stagnation region behind said aft closure, said gas stagnation region being effective to drive said aft closure away from the divider wall and toward the closed position upon exhaust gases being directed into said stagnation region.

* * * * *